US005372086A

United States Patent [19]

James

[11] Patent Number: 5,372,086

[45] Date of Patent: Dec. 13, 1994

[54] DODGER FOR SAILBOAT HAVING HARD COVER AND PROCESS FOR FABRICATION THEREOF

[76] Inventor: Bradley D. James, 1228 Brickyard Cove Rd., Point Richmond, Calif. 94801

[21] Appl. No.: 40,545

[22] Filed: Mar. 31, 1993

[51] Int. Cl.[5] ..... B63G 17/00

[52] U.S. Cl. ..... 114/361

[58] Field of Search ..... 114/343, 361, 364; 296/102; 135/88

[56] References Cited

U.S. PATENT DOCUMENTS

| | | | |
|---|---|---|---|
| 1,879,681 | 9/1932 | Harvey | 114/361 |
| 3,428,976 | 2/1969 | Robinson | 114/361 |
| 3,734,047 | 5/1973 | Burton | 114/361 |
| 4,569,554 | 2/1986 | Dodger | 296/102 |
| 5,009,463 | 4/1991 | Saitoh et al. | 296/210 |

FOREIGN PATENT DOCUMENTS

| | | | |
|---|---|---|---|
| 2099377 | 12/1982 | United Kingdom | 296/102 |

*Primary Examiner*—Edwin L. Swinehart

*Attorney, Agent, or Firm*—Townsend and Townsend Khourie and Crew

[57] ABSTRACT

A dodger with a hard fiberglass top shell is disclosed for mounting to a sailboat. A mold utilizing a flexible sheet—such as a ¼ inch plywood sheet—is warped and held interior of a surrounding frame rectilinear to match the desired profile of the hard top shell of the dodger. Warping occurs to match cabin camber with the port and starboard sides of the hard dodger top turning down to be approximately tangent to the cabin sides from the projected height of the dodger. The hard shell top is mounted above the deck by system of stanchions and upper and lower stanchion supports fastened to the deck and underside of the hard shell top respectively. The addition of front and side curtains completes the dodger assembly, which is easily constructed, easily removed, and easily repaired.

10 Claims, 5 Drawing Sheets

DODGER FOR SAILBOAT HAVING HARD COVER AND PROCESS FOR FABRICATION THEREOF

This invention relates to a weather cover for a sailboat known as a "dodger." More particularly, a dodger with a hard or fiberglass top is disclosed together with a process of fabrication of the dodger for fitting generically to all kinds of sail boats.

BACKGROUND OF THE INVENTION

Anyone who has ever operated a sailboat beating to weather in choppy water can attest to the relentless spray visited on the crew. Simply stated, the bow of the boat bobs up and down relative to the passing seas, throwing water into the air. The air, rushing over the surface of the water and boat hull, rapidly entrains the water carrying it aft into the eyes of the operating crew. The crew—who must look forward into the intended path of travel of the sailboat—are constantly bathed in sprays of relatively high velocity water. And when the water is salt water, stinging of the eyes results.

The solution to this problem is a structure known as a "dodger." The dodger is a shield having at least forward transparent walls behind which the crew can take refuge and even operate the boat in relative comfort.

Dodgers for sail boats are typically constructed of canvas draped over a series of pipe supports. In order understand the prior art, the system of pipe supports will be discussed first. Thereafter, the art of cutting and fitting of the canvas will be summarized.

Dodgers are supported on a system of pipe supports. Simply stated this system of pipe supports includes stainless steel forward and aft bows. The aft bow is typically hinge mounted to the after top portion of the deck house. This aft bow extends at an angle in the range of 30° relative to the fore and aft line of the deck house to define an arcuate bow for supporting the leading edge of the dodger. From the aft bow there is mounted a forward bow. This forward bow is fastened to the aft bow at an elevated location slightly above the deck house over which the dodger is mounted. From its mounting, the forward bow extends at an angle again of about 30° relative to the fore and aft line of the deck house. At its trailing edge, the aft bow defines a generally arcuate bow to which the trailing and open edge of the dodger is mounted. Typically there is added to the forward and/or aft bows and deck, one or more bars which maintain the system of bows as a rigid structure. Usually this system includes a vertical piece extending between the forward and aft bows and grad rails extending between the bows but mounted to the outside of the canvas surface of the dodger.

Making a dodger to fit the variant lines of sailboats is a work of art. Typically, the forward and aft bows have to be bent so that when they are angularly mounted at their respective 30° angles to the deck, they follow both the camber of the top of the deck house as well as the typically inward canted sides of the deck house. There after, canvas is cut and custom sewn to fit the lines of the bows. The top of the dodger is of canvas. The front and side panels mount to the dodger usually in a one piece integral construction. When finished, a well made canvas dodger appears integral to the boat almost as if the dodger were part of the original boat construction.

Unfortunately, sewn canvas has a finite life which in an over simplified manner can be described in two stages. First, and with approximately three years of sun, wind and weather, the stitching breaks down and the dodger must be resewn. Secondly, and at the end of six years, the canvas must be replaced. In either case, the canvas changes dimension. Consequently, the dodger must be re-worked or replaced by a skilled artisan as a whole and refit to the system of bows. In short, the maintenance of canvas dodgers is a labor intensive task requiring a skilled artisan.

Canvas dodgers have their drawbacks. They are not easily removed. Complete disassembly of both the canvas as it attaches to the frame and finally the frame itself is required. Further, and depending upon the particular cockpit configuration of a sailboat, the clearance between the bottom of the dodger and the cockpit "well" entering the sail boat can be small and cramped for those entering and leaving the below deck space of the sail boat. Unfortunately, the standard canvas dodger cannot make provision for overhead opening to facilitate below deck access.

SUMMARY OF THE INVENTION

A dodger with a hard fiberglass top shell is disclosed for mounting to a sailboat. The sailboat is measured for cabin width forward and underlying the dodger, and cabin width projected aft to the desired open end of the dodger. Thereafter, cabin camber and cabin port and starboard side wall interior inclination are measured and projected upwardly to the desired elevation of the dodger. These dimensions define the camber, and port and starboard dimension of the hard dodger top shell.

A mold utilizing a flexible sheet—such as a ¼ inch plywood sheet—is warped and held interior of a surrounding frame rectilinear to match the desired profile of the hard top shell of the dodger. Warping occurs to match cabin camber with the port and starboard sides of the hard dodger top turning down to be approximately tangent to the cabin sides from the projected height of the dodger. Preferably, a radius of curvature that matches the radius of curvature between the cabin top deck and cabin sides is utilized along the port and starboard sides of the hard fiber glass shell. Hard fiberglass layers lay up against the flexible membrane to impart desired shell shape.

Four upper stanchion mounts are placed on each corner of the hard fiberglass shell. Optionally, grab rails on the exterior of the hard shell can mate with the stanchion mounts or other reinforcing structure on the interior of the cabin shell. Thereafter, corresponding stanchion mounts are placed on the sailboat and the hard dodger shell secured by four stanchions with set screws to the stanchion mounts at the upper and lower end of each stanchion.

A front flange typically including front panel mounting means such as a zipper is placed at the forward leading edge of the hard dodger shell. Other flange arrangements can be used. Conventional soft canvas and transparent sectioned front and side panels are measured, sewn, and mounted from the hard fiber glass shell to the sail boat deck.

There results a dodger having almost identical appearance to the all canvas dodgers of the prior art which has an easily constructed, semi-permanent hard top shell. Furthermore, removal is vastly simplified. Further, the side panels can be easily constructed. Provision can be made for mounting conventional overhead hatches in the hard fiberglass top which can in many instances include a support surface from which sail and running rigging can be worked.

DESCRIPTION OF THE PREFERRED EMBODIMENT

Figure 1:
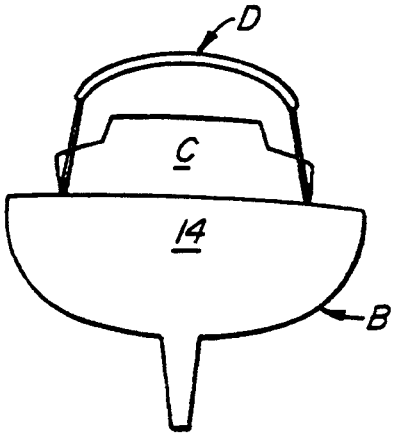
FIG. 1 is an athwart ships side elevation section of a sailboat taken through a cabin showing in broken lines the desired elevation at the section for a hard shell dodger of this invention.
Figure 2:
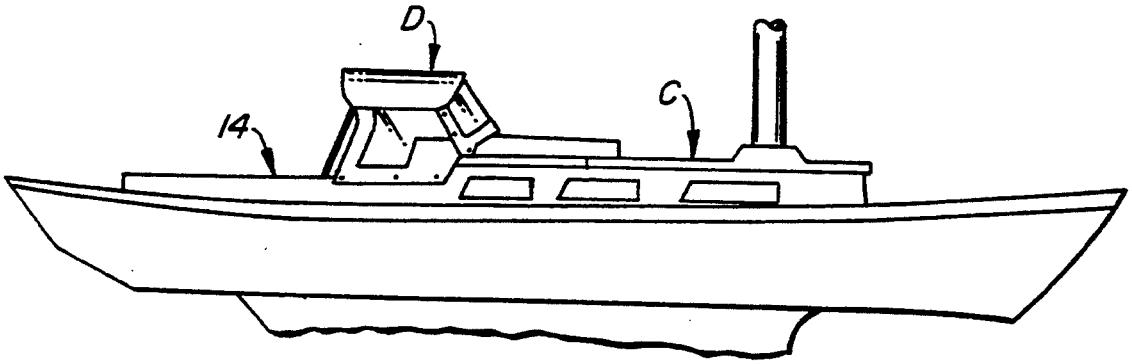
FIG. 2 is a side elevation view of the sailboat of FIG. 1 illustrating the corresponding the hard shell the dodger of this invention.
Figure 6:
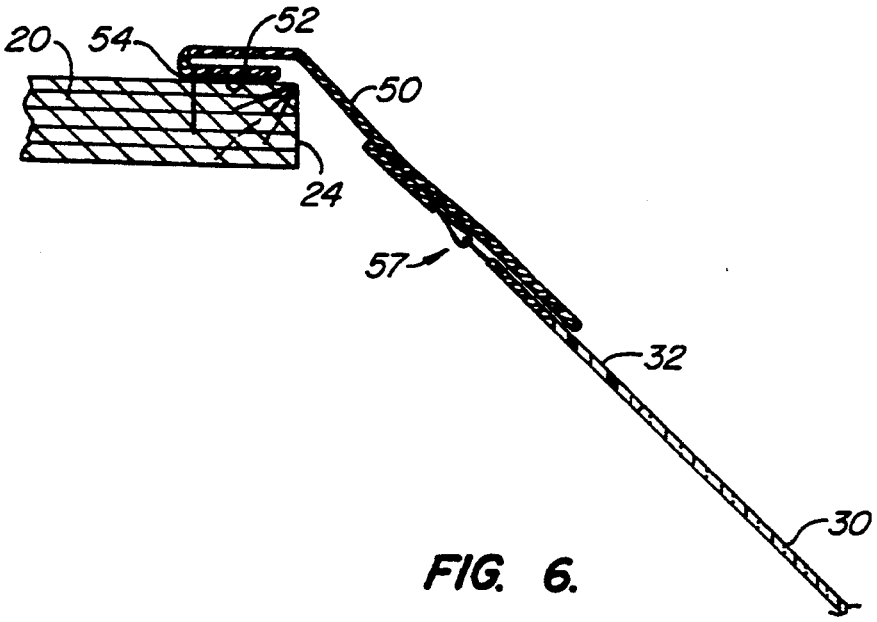
FIG. 6 is a construction schematic illustrating a typical attachment of the front window to the hard shell of the dodger.

Referring to FIGS. 1 and 2, a side elevation and stern view of sailboat B with integral cabin C and hard shell dodger D is illustrated. It will be seen that dodger D covers the after-end of cabin C as well as the forward portion of cockpit 14, a recessed main deck area aft of cabin C.

Figure 3:
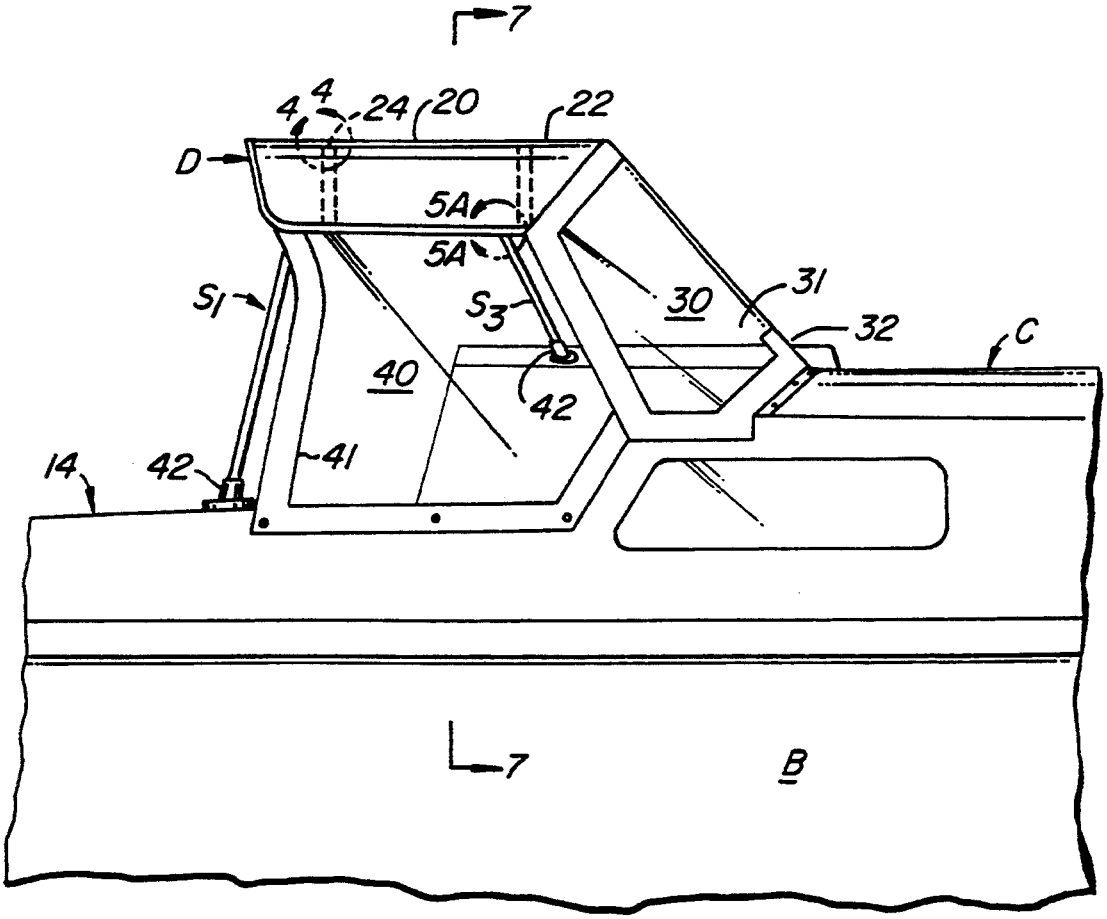
FIG. 3 is an expanded side elevation of the hard shell dodger.
Figure 4:
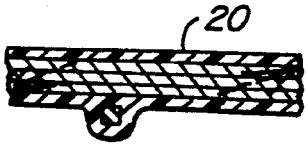
FIG. 4 is a laminate detail illustrating a multi-layer construction of the hard shell.

Turning to the side elevation of FIG. 3, hard shell top 20 is shown supported by stanchions $S_1$, $S_2$, $S_3$, and $S_4$, only stanchions $S_1$ and $S_3$ being visible in the illustrated view. Stanchions $S_1$, $S_2$, $S_3$, and $S_4$ function to maintain hard shell 20 a finite distance above both cabin C and cockpit 14. It will be understood that the hard shell is free standing in a solid support on the upper end of the stanchions.

Figure 8:
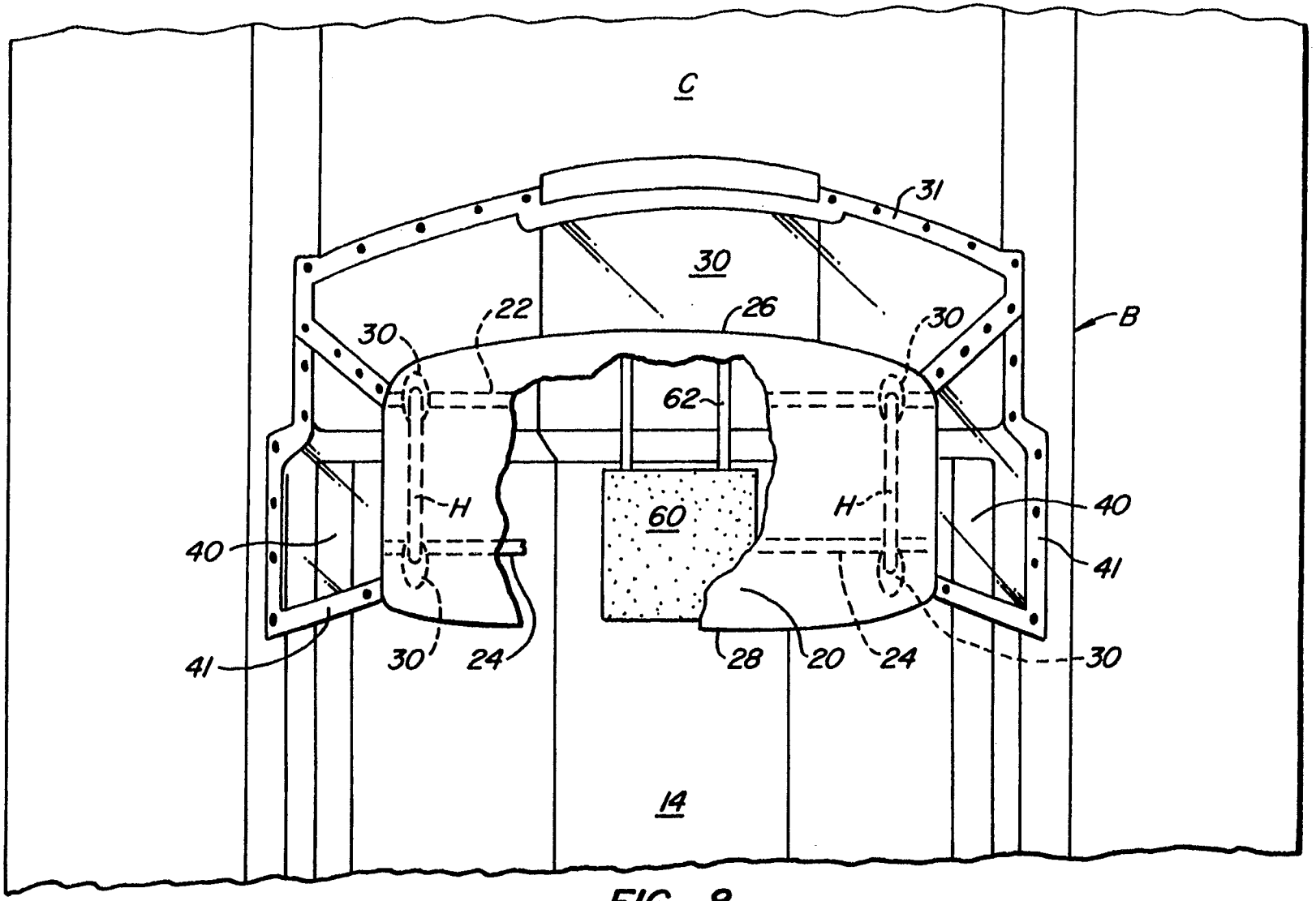
FIG. 8 is a top plan view of the dodger of this invention illustrating in broken lines the embedding of arcuate reinforcing members for securing the structural rigidity to the resulting hard shell dodger; and, FIG. 9 is a perspective view of a simple molding structure illustrating the fabrication of a hard top dodger.

Respective stanchion mounts are mounted at upper and lower ends of each of the respective stanchions $S_1$, $S_2$, $S_3$, and $S_4$. In the case of upper stanchion mounts, embedding in the laminates can occur. Alternately, and as seen on FIG. 8, stanchion mounts can back hand rail mounts 30 on either end of a shell attached hand rail H. Other mounting schemes can be used such as tubes embedded in top 20.

As illustrated in FIG. 3, a front curtain 30 having central transparent panel 31 surrounded by opaque panel portion 32 is shown. Attachment, especially at the upper forward dodger edge is conventional, and as will hereinafter set forth includes a zipper. The dodger D is completed by conventional attachment of side panels 40, this attachment preferably being made by conventional snaps at opaque edges 41

Dodger construction is easy to understand. Typically, dodger D includes paired arcuate reinforcing bars 22 forward and 24 aft. These arcuate reinforcing bars are here shown embedded in between the fourth and fifth laminates of a top formed from a total of 5 fiberglass laminated layers. Before discussing the particular shape of the top, comment can be directed to the structural rigidity.

Regarding the rigidity, bars 22, 24 maintain the desired arcuate configuration of the hard shell top 20. Thus, if during working of running rigging the crew leans against the shell, arcuate bars 22, 24 will maintain the required curvature. Further, and regarding the fore and aft stability of hard shell top 20, the arcuate shell itself as bent into its arcuate disposition itself takes on overall fore and aft structural rigidity. Consequently, the hard shell top 20 becomes a work or mounting surface which is relatively inflexible.

Figure 5A:
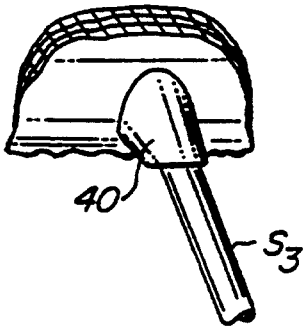
FIGS. 5A and 5B are details of the integral stanchion mounts built into and integrally molded with the hard shell top.
Figure 5B:
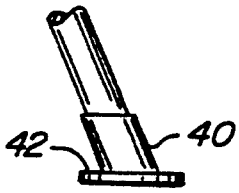

The hard shell top 20 is removably detachable. Specifically, stanchions $S_1$, $S_2$, $S_3$, and $S_4$ are set into respective upper stanchion mounts 40, these mounts being either fastened to the plastic laminate (See FIGS. 5A and **5*b*) or alternatively backing corresponding mounts to which hand rail H is attached—see FIG. 8. Lower stanchion mounts 42 are conventionally deck mounted to either cabin C or cockpit 14. In either case, loosen of a set screw at each upper stanchion mount 40 and lower stanchion mount 42 effectively detaches both stanchion and hard shell top 20**.

Mounting of the front panel 30 to the forward portion 24 of hard shell 20 can be understood. Cloth flange 50 having attached zipper 57 is stapled by monel staples 52, epoxy mounted and bent over the stapled layer to depend downward. Thereafter, opaque portion 31 of front panel 30 has a corresponding and mating zipper portion attached and conventional zipper removable attachment occurs. Regarding the zipper mount, it will be seen that the combination of cloth flange 50 and under lying zipper 57 effect an essentially water proof seal to the forward and leading edge of dodger D.

Figure 7:
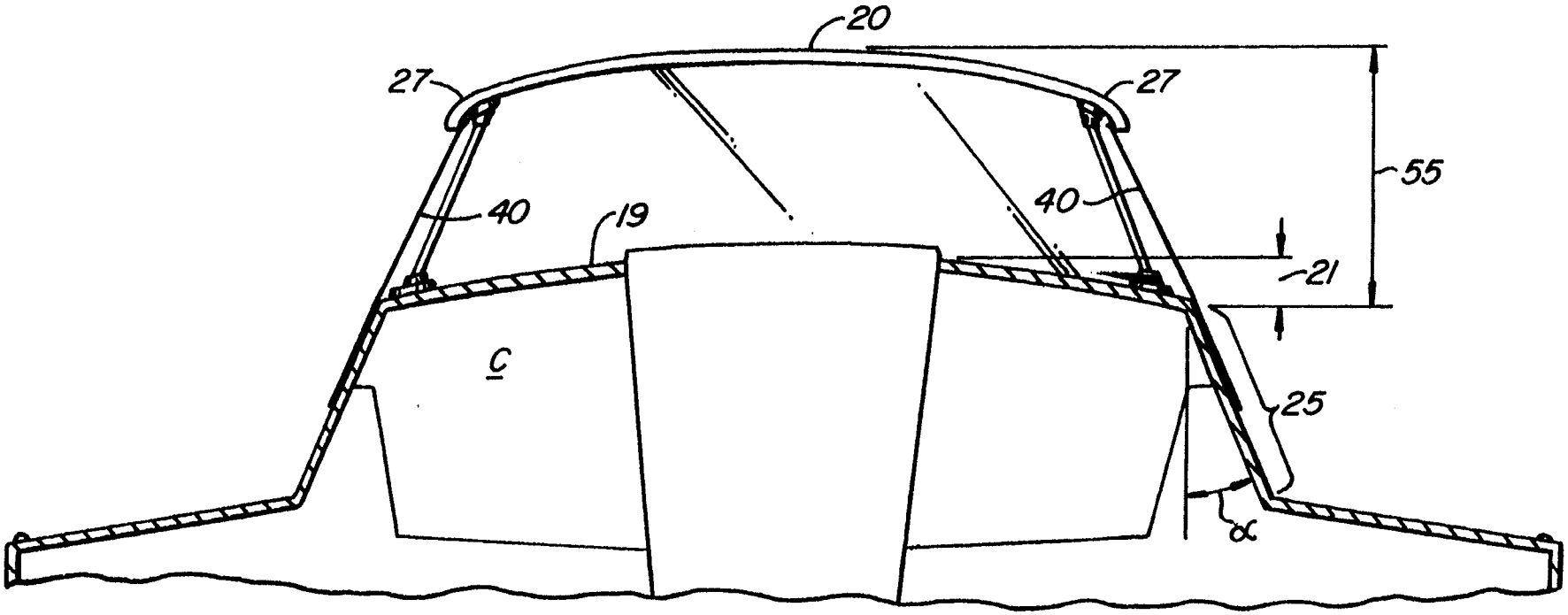
FIG. 7 is a vertical section at the cockpit taken through the hard shell dodger of this invention.

Mounting of side panels 40 at opaque portions 41 need not be as demanding. As shown in FIG. 7, mounting of opaque edges 41 at the inside upper edge 43 of hard shell top 20 with conventional exterior mounts 44 to the outside of the cabin C is all that is required in the normal case.

Having set forth the general construction, the important aspect of the shape of hard shell 20 will be discussed. To those having skill in the manufacture of conventional dodgers, it will be understood that the shaping here required is relatively simple. Thereafter, the roster of required measurement will be set forth. It will be seen that unlike the conventional dodger, the hard shell dodger of this invention can be measured, manufactured at a remote location, transported to a sailboat B, and mounted at the site to the sailboat.

Referring to FIG. 7, it can be seen that cabin C has a top deck having an arcuate camber resulting in side dimension 21 which is the difference between the highest point of elevation of cabin C and that point where cabin top 19 joins cabin exterior wall 25. In the preferred embodiment, this camber is measured and imparted to hard shell top 20.

Further referring to FIG. 7, it can be seen that wall 25 are typically inclined at an angle e from vertical. This is projected to the desired hard shell height 55. This determines the overall width of dodger D. Thereafter, the only requirement is that the edge 27 of hard shell 20 be bent downward in smooth line with side panels 40. This is necessary since the top of dodger D can be expected to be a surface from which running rigging can be worked; accordingly hard outward pointed side edges are unacceptable. It is preferred if this rounding match the rounding between cabin top 19 and sides 25.

Having set forth the general determination of the rounding of hard shell 20, the forward edge 26 and the trailing edge 28 are cut to the desired contour. Thereafter, addition of the panel mountings occurs.

The dodger D of this invention has an additional advantage. Specifically, the entrance into the interior of some cabins C is high; dodgers D in place over such entrances define limited access—particularly for elderly crew members. Accordingly, and because of the hard shell 20 here utilized, a conventional sliding hatch 60 mounted on rails 62 can be utilized to improve the required access. Similarly, hard shell 20 can constitute a mounting surface for instruments, underlying head liners, and the like.

Figure 9:
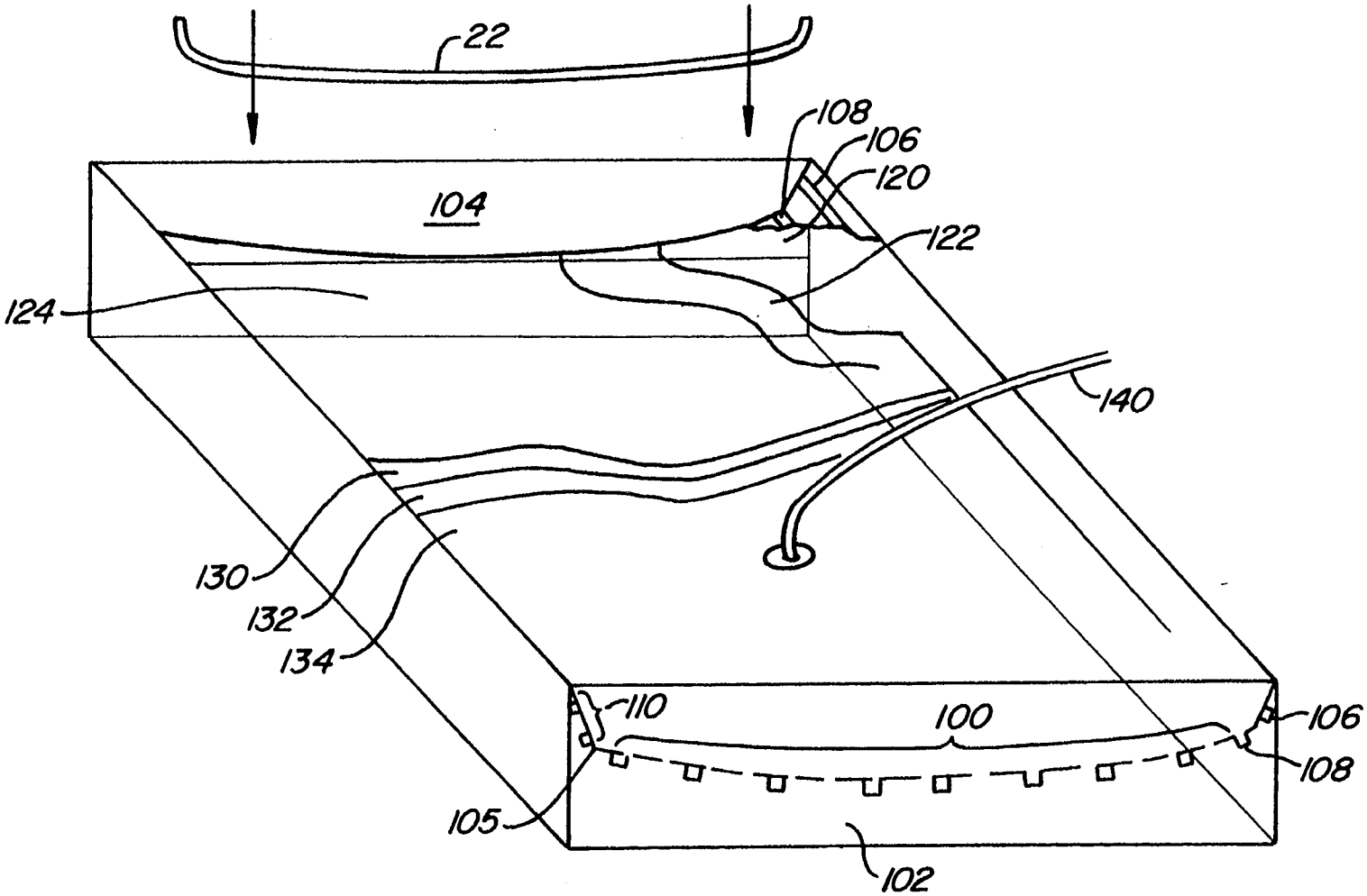

Referring to FIG. 9, laying up of hard shell liner can be understood. Specifically, the desired camber 100, cabin side projection 110, and radius of curvatures is plotted on one mold side 102, projected to the opposite mold side 104, and thereafter reinforced with one or more underlying ribs 106, 108 on the male side of the mold. Thereafter, plywood layer 120 and a release surface 122 is placed on the inside female surface of the mold. Layer 124, consisting of a plurality of layers of fiberglass is then placed on the female side of the mold and cured.

Thereafter, multiple layers of ⅛ plywood 130, 132, 134 are placed in the mold with epoxy interspersed therebetween and vacuum drawn at vacuum line 140 to the release surface after suitable edge sealing. Curing of the multilaminate top then occurs.

A final two layers are placed on top with stringers 22 (24 not being shown) placed into and glassed onto the formed multilaminate. There results the hard top shell 20 which is thereafter placed with a headliner—if desired.

The reader will understand that the illustrated molding process will admit of modification. However, it will be noted that the described process is capable of being done at a remote location, keeps sewing to an absolute minimums greatly simplifies fitting of the dodger to the top of the sail boat, and results in a top that does not deteriorate with the rapidity of an all canvas dodger. Furthermore, what canvas work remains for the fabrication of the front window and sides can be done by the routineer.

What is claimed is:

1. In a sailboat having:

a hull;

a main deck covering said hull;

a deck house protruding upwardly from said main deck, said deck house including a cabin top having camber from port to starboard of said cabin and cabin side walls from said main deck to said cabin top;

a cockpit behind said cabin, said cockpit defining a recessed sailboat crew operating area relative to said cabin behind said cabin;

a dodger for extending from above the top of said cabin at least partially over said cockpit for providing to said recessed sailboat crew operating area shelter from boat and wind generated spray, said dodger comprising in combination:

a hard top shell, said shell in extending from port to starboard side of said dodger a camber substantially equal to the camber of said deck house;

port and starboard down turned edges to said hard top shell, said port and starboard down turned edges terminating parallel to planes generally parallel to the port and starboard sides of said cabin between said cabin top and said main deck;

means for supporting said hard top shell above said cabin top and cockpit;

a forward edge defined on said hard top shell;

a cloth flange having a proximal edge fastened to said hard top shell of said dodger and distal edge away from said proximal edge for forming a point of attachment to a front panel, said cloth flange extending over said hard top shell at said camber substantially equal to the camber of said deck house, said cloth flange folded over said forward edge of said top shell and having means for fastening to said front panel at the distal edge thereof; and, a front panel fastened to said distal edge of said cloth flange having a transparent portion for permitting crew sheltered behind said dodger to take shelter within said dodger while observing the intended path of said boat.

2. The dodger of claim 1 and further comprising:

side panels from said hard top port and starboard sides extending to and fastening proximate to said port and starboard sides of said deck house.

3. The dodger of claim 1 and wherein said means for supporting said hard top shell above said cabin top and cockpit includes:

at least four stanchions, said stanchions having mounts on the bottom of said hard shell, corresponding mounts on said deck, and having a dimension sufficient to support said hard shell at the intended upper dimension of said dodger above said cabin deck and cockpit.

4. The dodger of claim 1 and wherein said hard shell top includes a head liner.

5. The dodger of claim 1 and wherein said hard shell top includes fore and aft arcuate frame member having the camber of said deck house with fiberglass reinforcement therebetween.

6. In a sailboat having:

a hull;

a main deck covering said hull;

a deck house protruding upwardly from said main deck, said deck house including a cabin top having camber from port to starboard of said cabin and cabin side walls from said main deck to said cabin top;

a cockpit behind said cabin, said cockpit defining a recessed sailboat crew operating area relative to said cabin behind said cabin;

a process for installing dodger for extending from above the top of said cabin at least partially over said cockpit for providing to said recessed sailboat crew operating area shelter from boat and wind generated spray, said process of installing said dodger comprising the steps of:

forming a hard top shell, said shell extending from port to starboard side of said dodger having a camber substantially equal to the camber of at the top of said deck house;

forming port and starboard down turned edges to said hard top shell, said port and starboard down turned edges terminating parallel to planes generally parallel to the port and starboard sides of said cabin between said cabin top and said main deck;

supporting said hard top shell above said cabin top and cockpit;

providing a cloth flange having a proximal edge for fastening to said hard top shell at a front portion of said hard shell top and distal edge away from said proximal edge for forming a point of attachment to a front panel;

fastening said cloth flange at said proximal edge to extend over said hard top shell with a camber substantially equal to the camber of said deck house, said cloth flange folded over said forward edge of said top shell;

providing means for fastening to said front panel at the distal edge of said cloth flange; and, providing a front panel having a transparent portion for permitting crew sheltered behind said dodger to take shelter within said dodger while observing the intended path of said boat; and fastening said cloth flange at said distal edge to said front panel.

7. The process of installing the dodger of claim 6 and further including the steps of:

providing and removably attaching side panels from said hard top port and starboard sides extending to and fastening proximate to said port and starboard sides of said deck house.

8. The process of installing the dodger of claim 7 and wherein said supporting step includes the steps of:

providing at least four stanchions;

providing stanchion mounts on the bottom of said hard shell;

providing corresponding mounts on said deck; providing stanchions have dimension sufficient to support said hard shell at the intended upper dimension of said dodger above said cabin deck and cockpit; and, fastening said stanchions between said stanchion mounts to support said hard top.

9. The process of installing the dodger of claim 6 and further including the steps of:

fastening to the bottom of said hard shell top a head liner.

10. The process of installing the dodger of claim 6 and further including the steps of:

providing fore and aft arcuate frame member having the camber of said deck house with fiberglass reinforcement therebetween;

fastening said fore and aft arcuate frame members to said hard shell top.

* * * * *